US010205216B2

(12) United States Patent
Talty et al.

(10) Patent No.: US 10,205,216 B2
(45) Date of Patent: Feb. 12, 2019

(54) THIN FILM ANTENNA TO FAKRA CONNECTOR

(71) Applicant: GM GLOBAL TECHNOLOGY OPERATIONS LLC, Detroit, MI (US)

(72) Inventors: Timothy J. Talty, Beverly Hills, MI (US); Keerti S. Kona, Woodland Hills, CA (US); Hyok Jae Song, Oak Park, CA (US); James H. Schaffner, Chatsworth, CA (US); Amit M. Patel, Santa Monica, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 102 days.

(21) Appl. No.: 15/583,335

(22) Filed: May 1, 2017

(65) Prior Publication Data

US 2017/0324143 A1 Nov. 9, 2017

Related U.S. Application Data

(60) Provisional application No. 62/332,666, filed on May 6, 2016.

(51) Int. Cl.
*H01R 35/00* (2006.01)
*H01Q 1/12* (2006.01)
(Continued)

(52) U.S. Cl.
CPC ..... *H01Q 1/1271* (2013.01); *H01P 5/028* (2013.01); *H01P 5/085* (2013.01); *H01Q 1/38* (2013.01);
(Continued)

(58) Field of Classification Search
CPC ..... H01P 5/085; H01P 5/028; H01R 2201/02; H01R 2201/26; H01R 12/7076;
(Continued)

(56) References Cited

U.S. PATENT DOCUMENTS 8,814,601 B1 * 8/2014 Sherrer ..... H01R 4/34 439/625
2003/0203717 A1 * 10/2003 Chuprun ..... G06K 13/0825 455/12.1
(Continued)

*Primary Examiner* — Jean F Duverne
(74) *Attorney, Agent, or Firm* — Cantor Colburn LLP

(57) ABSTRACT

A connector assembly that provides a proper impedance connection between a CPW antenna mounted on automotive glass to a FAKRA-type connector. The connector assembly includes a PCB having a top surface and a bottom surface and being adhered to the glass. Vias are provided through the PCB to make electrical contact between metallization planes on the top surface and the bottom surface of the PCB. Terminals that are part of the connector extend through some of the vias, where ground terminals provide mechanical stability and make electrical contact with the metallization planes on the bottom surface of the PCB and a signal terminal provides an electrical connection to the antenna radiating element. The PCB is adhered to a substrate on which the antenna is mounted so that the metallization planes and microstrip lines make electrical contact with a CPW feed structure that feeds the antenna.

20 Claims, 4 Drawing Sheets

(51) Int. Cl.

| | |
|---|---|
| ***H01Q 1/38*** | (2006.01) |
| ***H01Q 1/48*** | (2006.01) |
| ***H01Q 13/20*** | (2006.01) |
| ***H01R 12/70*** | (2011.01) |
| ***H01P 5/02*** | (2006.01) |
| ***H01P 5/08*** | (2006.01) |

(52) U.S. Cl.
CPC ..... *H01Q 1/48* (2013.01); *H01Q 13/203* (2013.01); *H01Q 13/206* (2013.01); *H01R 12/7076* (2013.01); *H01R 2201/02* (2013.01); *H01R 2201/26* (2013.01)

(58) Field of Classification Search
CPC ..... H01R 4/34; H01Q 1/1271; H01Q 1/38; H01Q 13/206; H01Q 13/203; H01Q 1/48
See application file for complete search history.

(56) References Cited

U.S. PATENT DOCUMENTS

2008/0129408 A1* 6/2008 Nagaishi ..... H01P 5/107 333/33
2015/0333724 A1* 11/2015 Lahti ..... H01Q 13/06 343/860
2016/0380346 A1* 12/2016 Komulainen ..... H01Q 1/521 343/841

* cited by examiner

THIN FILM ANTENNA TO FAKRA CONNECTOR

CROSS-REFERENCE TO RELATED APPLICATIONS

This application claims the benefit of the priority date of U.S. Provisional Patent Application Ser. No. 62/332,666, titled, Thin Film Antenna to Fakra Connector, filed May 6, 2016.

BACKGROUND OF THE INVENTION

Field of the Invention

This invention relates generally to an RF connector assembly for connecting a thin film, planar antenna to a connector and, more particularly, to an RF connector assembly for connecting a thin film, co-planar waveguide (CPW) antenna adhered to automotive glass to a FAKRA-type connector.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increase, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass typically makes a good dielectric substrate for an antenna. For example, it is known in the art to print AM and FM antennas on the glass of a vehicle where the printed antennas are fabricated within the glass as a single piece. However, these known systems are generally limited in that they can only be placed in a vehicle windshield or other glass surface in areas where viewing through the glass is not necessary.

SMB connectors are commonly employed for connecting RF elements, such as an antenna to a coaxial cable. Often times, SMB connectors include an over-molded plastic structure to provide a robust mechanical connection. This combination of an SMB connector with the over-molded plastic is commonly known in the art as a FAKRA-type connector. Thus, for antennas designed and implemented on a planar structure, such as automotive glass, a low profile connector typically needs to be employed to transition from the CPW antenna feed structure to the FAKRA-type connector to enable the antenna to be connected to the coaxial cable.

SUMMARY OF THE INVENTION

The present invention discloses and describes an RF connector assembly that provides a proper impedance connection between a CPW antenna mounted on automotive glass, or other suitable dielectric structures, to a FAKRA-type connector for connecting the antenna to a coaxial cable. The connector assembly includes a printed circuit board (PCB) having a top surface and a bottom surface and being adhered to the glass. Vias are provided through the PCB to make electrical contact between metallization planes on the top surface and the bottom surface of the PCB. Terminals that are part of the connector extend through some of the vias, where ground terminals provide mechanical stability and make electrical contact with the metallization planes on the bottom surface of the PCB and a signal terminal provides an electrical connection to the antenna radiating element. The PCB is adhered to a substrate on which the antenna is mounted so that the metallization planes and microstrip lines make electrical contact with a CPW feed structure that feeds the antenna.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a connector assembly for providing an RF connection between a thin film, flexible antenna adhered to a dielectric structure and a FAKRA-type connector is merely exemplary in nature, and is in no way intended to limit the invention or its applications or uses. For example, the discussion herein talks about the connector assembly being applicable to connect a CPW antenna mounted on automotive glass to a FAKRA-type connector. However, as will be appreciated by those skilled in the art, the connector will have application for connecting other electronic devices on other types of substrates.

Figure 1:
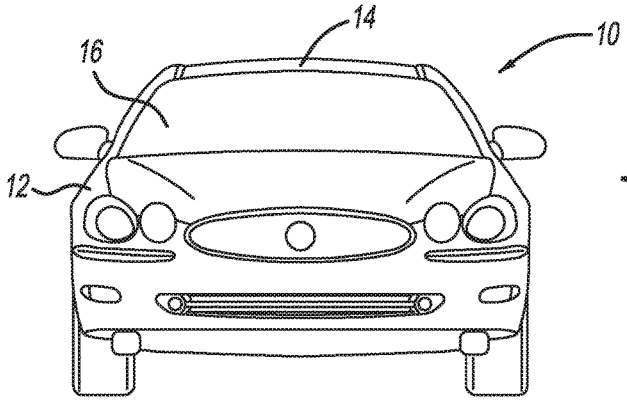
FIG. 1 is a front view of a vehicle showing a vehicle windshield.
Figure 2:
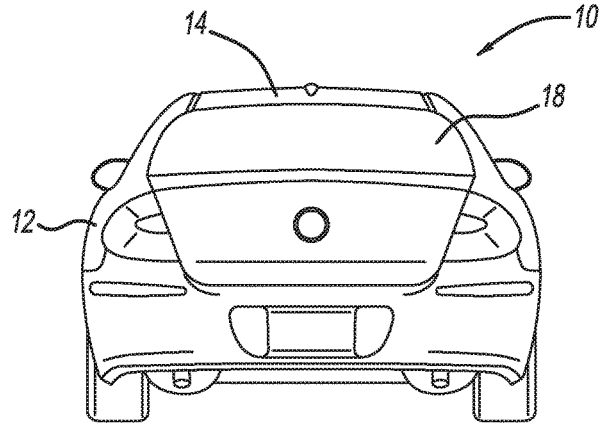
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18.

It may be desirable to provide a thin film, CPW antenna on the windshield 16, the rear window 18, or any other window or dielectric structure on the vehicle 10, where the antenna is flexible to conform to the shape of the particular dielectric structure, and where the antenna can be mounted at any suitable location on the dielectric structure, including locations on the windshield 16 that the vehicle driver needs to see through. The antenna may operate in a frequency band suitable for various communications systems, such as AM/FM radio antennas, DSRC antennas, satellite radio antennas, GPS antennas, cellular antennas, including MIMO antennas, etc. The antenna can be a wideband monopole appliqué antenna that is installed directly on the surface of the dielectric structure by a suitable adhesive. The antenna structure can be designed to operate on automotive glass of various physical thicknesses and dielectric properties, where the antenna structure operates as intended when installed on the glass or other dielectric since in the design process the glass or other dielectric is considered in the antenna geometry pattern development.

Figure 3:
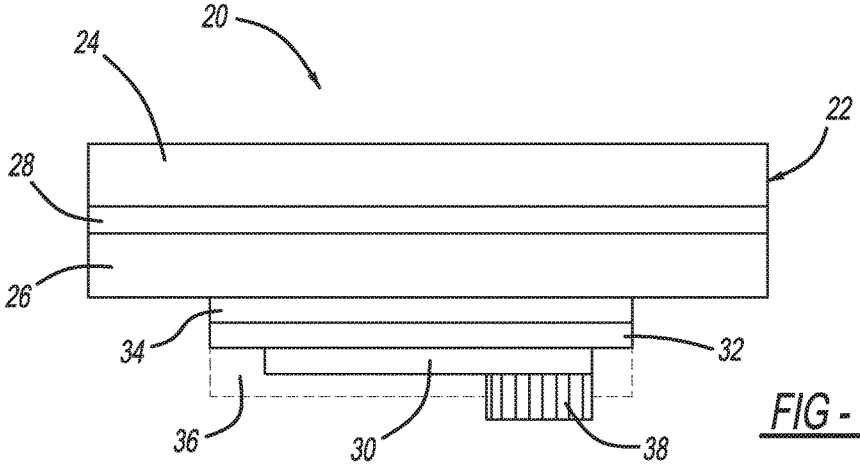
FIG. 3 is a profile view of a vehicle window including a thin film, flexible antenna formed thereon.

FIG. 3 is a profile view of an antenna structure 20 including a windshield 22 having an outer glass layer 24, an inner glass layer 26 and a polyvinyl butyral (PVB) layer 28 therebetween. The structure 20 includes an antenna 30 formed on a thin, flexible film substrate 32, such as polyethylene terephthalate (PET), biaxially-oriented polyethylene terephthalate (BoPET), flexible glass substrates, mylar, Kapton, etc., and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector such as a direct pig-tail or coaxial cable connection. Although the antenna 30 is shown being coupled to an inside surface of the inner glass layer 26, the conductor 30 can be adhered to the outer surface of the outer glass layer 24 or the surface of the layers 24 or 26 adjacent to the PVB layer 28 or the surfaces of the PVB layer 28.

The antenna 30 can be formed by any suitable low loss conductor, such as copper, gold, silver, silver ceramic, metal grid/mesh, etc. If the antenna 30 is at a location on the vehicle glass that requires the driver or other vehicle occupant to see through the glass, then the antenna conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary approximately over 2.8 mm-5 mm and have a relative dielectric constant $\varepsilon_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass, a backing layer of the transfer tape can be removed. By providing the antenna conductor on the inside surface of the vehicle windshield 22, degradation of the antenna 30 can be reduced from environmental and weather conditions.

As will be discussed in detail below, the present invention proposes a suitable low profile RF connector assembly that can be used in place of the connector 38 for connecting the antenna structure 20 to a coaxial cable through a FAKRA-type connector. More specifically, the RF connector assembly provides desirable features including proper impedance matching to couple a CPW antenna mounted on vehicle glass to the FAKRA-type connector. The connector assembly will have application for antennas employed for any of the communications systems referred to above, and in, for example, the 500 MHz-6.0 GHz frequency band.

Figure 4:
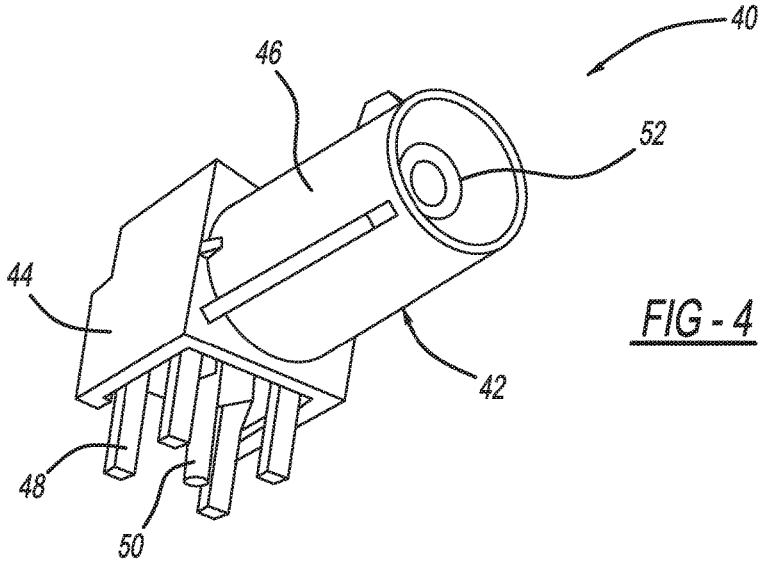
FIG. 4 is an isometric view of a FAKRA-type RF connector.

FIG. 4 is an isometric view of a FAKRA-type connector 40 of the type being discussed herein that is applicable to provide an RF connection to a CPW feed structure for an antenna formed on a dielectric substrate, such as automotive glass. The connector 40 includes an outer housing 42 having a generally square mounting portion 44 and a generally cylindrical connecting portion 46, where the housing 42 is made of a suitable impact resistant, corrosion resistant, etc. plastic. The connector 40 includes a series of four terminals 48, referred to in the industry as "feet," that are operable to provide a mechanical connection to a substrate and also provide an electrical ground connection, as will become apparent from the discussion below. A signal pin 50 is positioned central to the terminals 48 and provides an electrical connection to the antenna radiating element through a feed structure as will also become apparent from the discussion below. The connector 40 includes suitable electrical elements and connections positioned within the housing 42 so that the terminals 48 make electrical contact with a cylindrical ground connector 52 positioned within the connecting portion 46 of the housing 42, where a signal terminal is positioned within the cylindrical connector 52, and allows an RF coaxial cable (not shown) to be coupled thereto.

Figure 5:
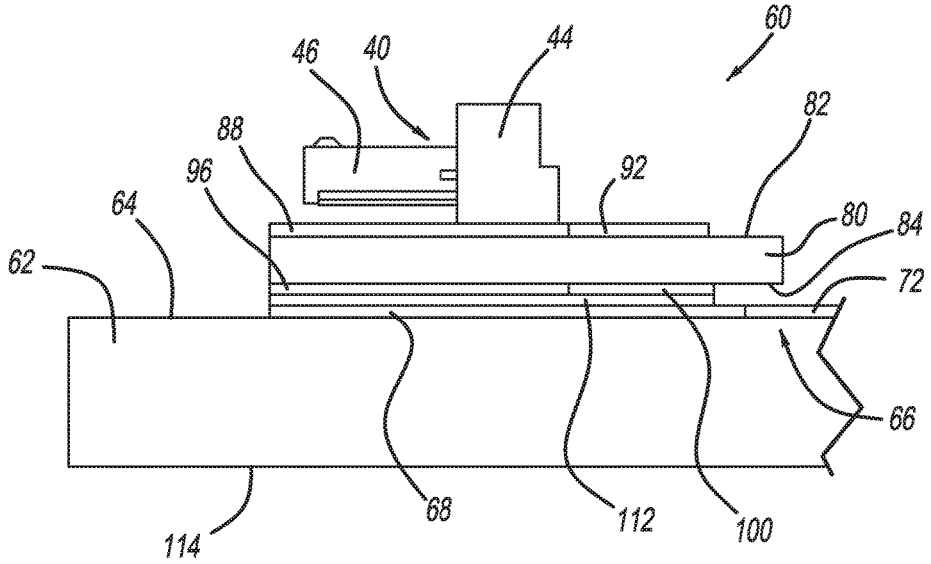
FIG. 5 is a broken-away profile view of a connector assembly including the connector shown in FIG. 4 being coupled to an antenna feed structure.
Figure 6:
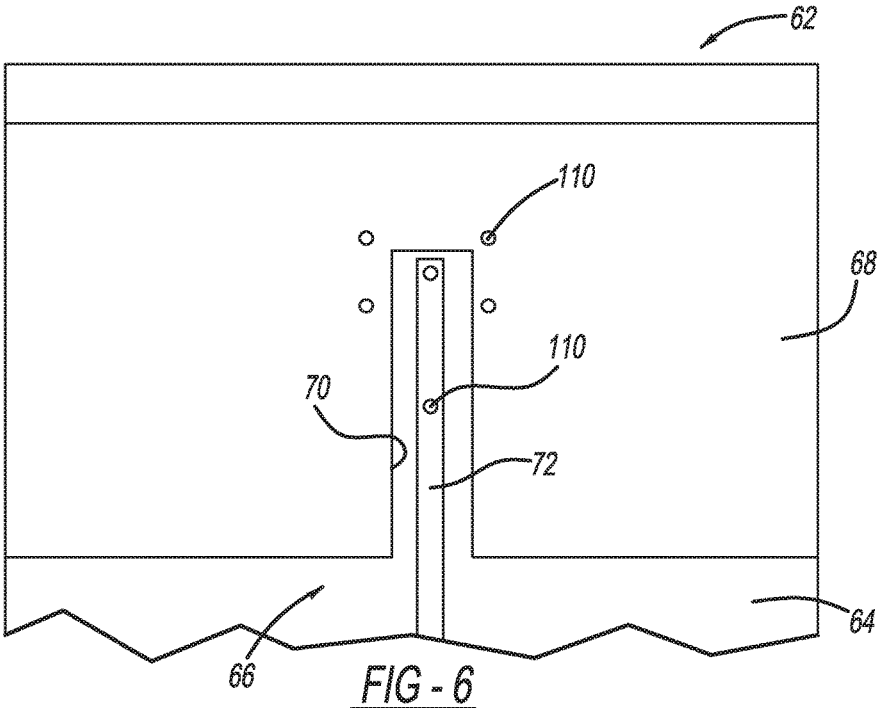
FIG. 6 is a broken-away top side view of an antenna substrate including the antenna feed structure.

FIG. 5 is a cut-away profile view of a connector assembly 60 showing the connector 40 being electrical coupled to a thin film antenna of the type discussed above that is mounted to a surface of a dielectric substrate 62, such as automotive glass. The substrate 62 is shown broken away, where the antenna is not specifically identified, but where a CPW feed structure 66 is shown mounted to a top surface 64 of the substrate 62. FIG. 6 is a cut-away top view of the substrate 62 showing the CPW feed structure 66, which includes a ground metallization plane 68 defining a slot 70 in which is positioned a microstrip line 72 that is part of and/or electrically coupled to the radiating element of the antenna and is electrically separated from the ground plane 68.

Figure 7:
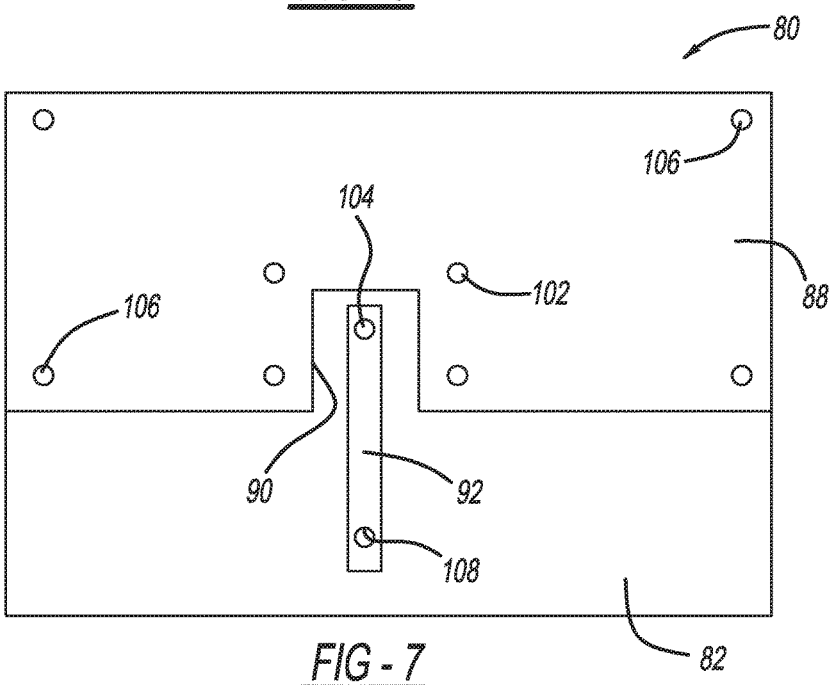
FIG. 7 is a top side view of a PCB in the connector assembly.
Figure 8:
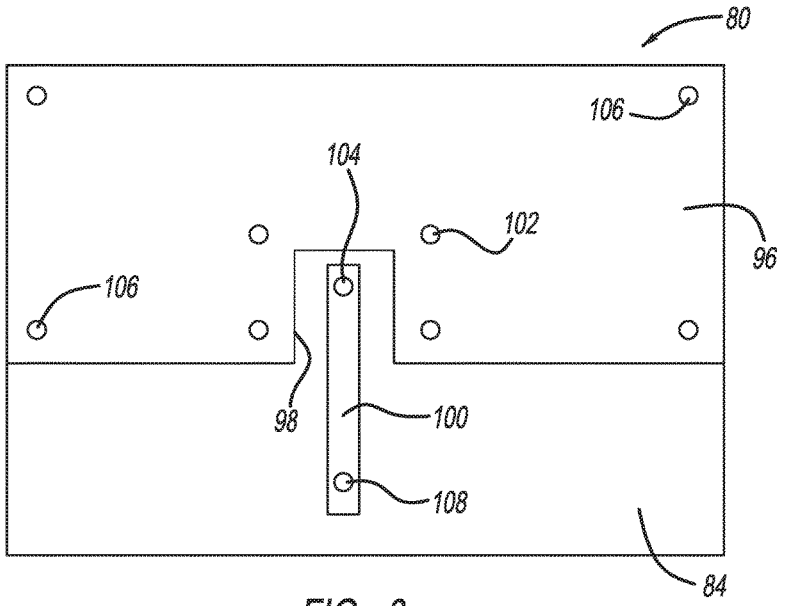
FIG. 8 is a bottom side view of the PCB in the connector assembly.

The connector assembly 60 also includes a PCB 80 having a top surface 82 and a bottom surface 84 and being mounted to the top surface 64 of the substrate 62, as will be discussed in detail below. FIG. 7 is a top side view of the PCB 80 and FIG. 8 is a bottom side view of the PCB 80. The top surface 82 of the PCB 80 includes a ground metallization plane 88 defining a slot 90 in which is positioned a microstrip line 92 electrically separated from the metallization plane 88. Likewise, the bottom surface 84 of the PCB 80 includes a ground metallization plane 96 defining a slot 98 in which is positioned a microstrip line 100 electrically separated from the metallization plane 96.

Four via holes 102 are provided through the PCB 80 and the metallization planes 88 and 96, and are provided around the slots 90 and 98, as shown, where the spacing between the vias 102 matches the spacing between the terminals 48. Further, a via 104 is provided through the PCB 80 and the microstrip lines 92 and 100, and is positioned to accept the signal pin 50 of the connector 40. The connector 40 is positioned on the top surface 82 of the PCB 80 so that the terminals 48 align with the vias 102 and the signal pin 50 aligns with the via 104 so that the terminals 48 and the pins 50 extend through the PCB 80. A suitable soldering process is then employed to secure the connector 40 to the PCB 80 so that the terminals 48 make electrical contact with the metallization planes 88 and 96 and the signal pin 50 makes electrical contact with the microstrip lines 92 and 100, where the terminals 48 provide mechanical rigidity. Additional optional vias 106 and 108 can be provided through the PCB 80, the metallization planes 88 and 96, and the microstrip lines 92 and 100, and be filled with a suitable metal to make further electrical contact between the metallization planes 88 and 96 and the microstrip lines 92 and 100.

The top surface 64 of the substrate 62 includes alignment dots 110 provided on both the metallization plane 68 and the microstrip line 72, as shown. The alignment dots 110 are aligned with the vias 102 and 104 so that the PCB 80 is properly oriented relative to the substrate 62. The PCB 80 is adhered to the substrate 82 by a suitable adhesive layer 112 that allows electrical contact between the metallization plane 96 and the metallization plane 68, and the microstrip line 100 and the microstrip line 72. Thus, the microstrip line 72 is electrically coupled to the signal pin 50. It is noted that all of the metallization planes and microstrip lines being discussed can be optically transparent, as discussed above.

Figure 9:
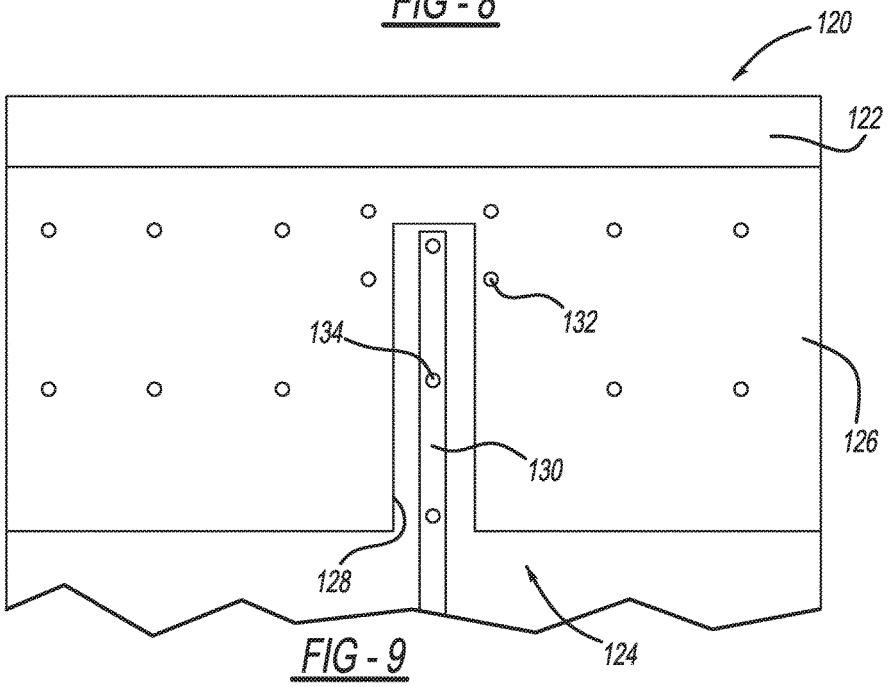
FIG. 9 is a bottom side view of an antenna substrate including an antenna feed structure that can replace the antenna substrate shown in FIG. 5.

In other embodiments, the antenna may be provided on a bottom surface 114 of the substrate 62, such as an inside surface of the vehicle glass. FIG. 9 is a bottom side view of an antenna substrate 120 that can replace the antenna substrate 62 to show this embodiment, where the substrate 120 includes a bottom surface 122. In this embodiment, the microstrip line 72 is replaced with a microstrip line (not shown) similar to the microstrip line 100 that makes electrical contact with the microstrip line 100 through the adhesive layer 112. A CPW antenna feed structure 124 is provided on the bottom surface 122 and includes a metallization ground plane 126 defining a slot 128 in which is positioned a microstrip line 130 that is electrically coupled to the radiating element of the antenna. A series of electrical vias 132 are provided through the substrate 120 that make electrical contact with the metalization plane 126 and the metallization plane 68 and a plurality of vias 134 are provided through the substrate 120 that make electrical contact between the microstrip line 130 and the microstrip line that replaces the microstrip line 72.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An RF connector assembly for connecting a co-planar waveguide (CPW) antenna mounted on a substrate to a FAKRA-type connector, said CPW antenna including a ground plane, an antenna radiating element, and a CPW feed structure, said RF connector assembly comprising:

a printed circuit board (PCB) including a top surface and a bottom surface, a first ground metallization plane formed on the top surface of the PCB, a first microstrip line formed on the top surface of the PCB and being electrically separated from the first ground plane, a second ground metallization plane formed to the bottom surface of the PCB, a second microstrip line formed on the bottom surface of the PCB and being electrically separated from the second ground plane, and a plurality of vias extending through the PCB some of which make electrical contact between the first and second ground metallization planes and some of which make electrical contact between the first and second microstrip lines, said PCB being secured to the substrate so that the second ground metallization plane and the second microstrip line make electrical contact with the CPW feed structure, wherein some of the vias are positioned to accept ground terminals of the FAKRA-type connector that extend through the PCB and make electrical contact with the second ground metallization plane and one of the vias is positioned to accept a signal pin of the FAKRA-type connector that makes electrical contact with the first and second microstrip lines.

2. The RF connector assembly according to claim 1 wherein the CPW antenna is formed to a top surface of the substrate adjacent to the bottom surface of the PCB.

3. The RF connector assembly according to claim 1 wherein the CPW antenna is formed to a bottom surface of the substrate opposite to the PCB, wherein the connector assembly further comprises a third metallization plane formed to a top surface of the substrate and making electrical contact with the second metallization plane and a third microstrip line formed to the top surface of the substrate and making electrical contact with the second microstrip line.

4. The RF connector assembly according to claim 1 wherein the substrate is a glass substrate.

5. The RF connector assembly according to claim 4 wherein the glass substrate is a vehicle window.

6. The RF connector assembly according to claim 1 wherein the FAKRA-type connector is connected to a coaxial cable.

7. The RF connector assembly according to claim 1 wherein the antenna includes transparent conductors.

8. The RF connector assembly according to claim 1 wherein the antenna is formed on a thin film substrate.

9. The RF connector assembly according to claim 8 wherein the thin film substrate is selected from the group consisting of mylar, Kapton, PET and flexible glass substrates.

10. The RF connector assembly according to claim 1 wherein the ground plane includes a slot and the antenna radiating element is positioned within the slot.

11. The RF connector assembly according to claim 1 wherein the antenna operates in a frequency band suitable for AM/FM radio antennas, DSRC antennas, satellite radio antennas, GPS antennas, or cellular antennas.

12. An RF connector assembly for connecting a co-planar waveguide (CPW) antenna mounted on a vehicle glass to a FAKRA-type connector, said CPW antenna including a ground plane, an antenna radiating element, and a CPW feed structure, wherein the antenna operates in a frequency band suitable for AM/FM radio antennas, DSRC antennas, satellite radio antennas, GPS antennas, or cellular antennas, said RF connector assembly comprising:

a printed circuit board (PCB) including a top surface and a bottom surface, a first ground metallization plane formed on the top surface of the PCB, a first microstrip line formed on the top surface of the PCB and being electrically separated from the first ground plane, a second ground metallization plane formed to the bottom surface of the PCB, a second microstrip line formed on the bottom surface of the PCB and being electrically separated from the second ground plane, and a plurality of vias extending through the PCB some of which make electrical contact between the first and second ground metallization planes and some of which make electrical contact between the first and second microstrip lines, said PCB being secured to the vehicle glass so that the second ground metallization plane and the second microstrip line make electrical contact with the CPW feed structure, wherein some of the vias are positioned to accept ground terminals of the FAKRA-type connector that extend through the PCB and make electrical contact with the second ground metallization plane and one of the vias is positioned to accept a signal pin of the FAKRA-type connector that makes electrical contact with the first and second microstrip lines.

13. The RF connector assembly according to claim 12 wherein the CPW antenna is formed to a top surface of the vehicle glass adjacent to the bottom surface of the PCB.

14. The RF connector assembly according to claim 12 wherein the CPW antenna is formed to a bottom surface of the vehicle glass opposite to the PCB, wherein the connector assembly further comprises a third metallization plane formed to a top surface of the vehicle glass and making electrical contact with the second metallization plane and a third microstrip line formed to the top surface of the vehicle glass and making electrical contact with the second microstrip line.

15. The RF connector assembly according to claim 12 wherein the antenna includes transparent conductors.

16. The RF connector assembly according to claim 12 wherein the ground plane includes a slot and the antenna radiating element is positioned within the slot.

17. An RF connector assembly for connecting a co-planar waveguide (CPW) antenna mounted on a thin-film substrate to a FAKRA-type connector, said CPW antenna including a ground plane, an antenna radiating element, and a CPW feed structure, wherein the ground plane includes a slot and the antenna radiating element is positioned within the slot, and wherein the FAKRA-type connector is connected to a coaxial cable, said RF connector assembly comprising:

a printed circuit board (PCB) including a top surface and a bottom surface, a first ground metallization plane formed on the top surface of the PCB, a first microstrip line formed on the top surface of the PCB and being electrically separated from the first ground plane, a second ground metallization plane formed to the bottom surface of the PCB, a second microstrip line formed on the bottom surface of the PCB and being electrically separated from the second ground plane, and a plurality of vias extending through the PCB some of which make electrical contact between the first and second ground metallization planes and some of which make electrical contact between the first and second microstrip lines, said PCB being secured to the substrate so that the second ground metallization plane and the second microstrip line make electrical contact with the CPW feed structure, wherein some of the vias are positioned to accept ground terminals of the FAKRA-type connector that extend through the PCB and make electrical contact with the second ground metallization plane and one of the vias is positioned to accept a signal pin of the FAKRA-type connector that makes electrical contact with the first and second microstrip lines.

18. The RF connector assembly according to claim 17 wherein the CPW antenna is formed to a top surface of the substrate adjacent to the bottom surface of the PCB.

19. The RF connector assembly according to claim 17 wherein the CPW antenna is formed to a bottom surface of the substrate opposite to the PCB, wherein the connector assembly further comprises a third metallization plane formed to a top surface of the substrate and making electrical contact with the second metallization plane and a third microstrip line formed to the top surface of the substrate and making electrical contact with the second microstrip line.

20. The RF connector assembly according to claim 17 wherein the substrate is a glass substrate.

* * * * *